US009671170B2

(12) United States Patent
Hermida Dominguez et al.

(10) Patent No.: US 9,671,170 B2
(45) Date of Patent: Jun. 6, 2017

(54) HEAT EXCHANGE DEVICE FOR EXCHANGING HEAT BETWEEN FLUIDS

(71) Applicants: BORGWARNER INC., Auburn Hills, MI (US); BORGWARNER EMISSIONS SYSTEMS SPAIN, S.L., Vigo-Pon-tevedra (ES)

(72) Inventors: Xoan Xose Hermida Dominguez, Gondomar (ES); Alvaro Sanchez Ragnarson, Gondomar (ES); Jose Alberto Blanco Fernandez, Virgo (ES); Jose Luis Souto Martinez, Gondomar (ES)

(73) Assignee: Borgwarner Emissions Systems Spain, S.L.U., Vigo, Pontevedra (ES)

( * ) Notice: Subject to any disclaimer, the term of this patent is extended or adjusted under 35 U.S.C. 154(b) by 210 days.

(21) Appl. No.: 14/441,059

(22) PCT Filed: Nov. 5, 2013

(86) PCT No.: PCT/EP2013/073012
§ 371 (c)(1),
(2) Date: May 6, 2015

(87) PCT Pub. No.: WO2014/072274
PCT Pub. Date: May 15, 2014

(65) Prior Publication Data

US 2015/0292804 A1 Oct. 15, 2015

(30) Foreign Application Priority Data

Nov. 6, 2012 (EP) ..... 12382434

(51) Int. Cl.
*F28F 3/08* (2006.01)
*F28D 7/00* (2006.01)
(Continued)

(52) U.S. Cl.
CPC ..... *F28D 7/0066* (2013.01); *F02M 26/32* (2016.02); *F28D 7/1684* (2013.01);
(Continued)

(58) Field of Classification Search
CPC .. F28D 7/0066; F28D 2235/00; F28D 9/0219; F28D 7/1684; F28D 2225/08; F28D 2009/226
(Continued)

(56) References Cited

U.S. PATENT DOCUMENTS 4,991,647 A 2/1991 Kawabe et al.
5,471,913 A * 12/1995 Margittai ..... F28F 3/083 165/167
(Continued)

FOREIGN PATENT DOCUMENTS

DE 10312788 9/2004
DE 102009053884 6/2011
(Continued)

*Primary Examiner* — Davis Hwu
(74) *Attorney, Agent, or Firm* — Miller Canfield

(57) ABSTRACT

The present invention relates to a heat exchange device for exchanging heat between two fluids circulating through insulated conduits. In the preferred example the first fluid is a hot gas originating from an exhaust gas recirculation (EGR) system, and the second fluid is a coolant liquid used for removing heat from the hot gas. The device according to the invention has a simple and cheap construction, lacking a shell, formed by a plurality of extruded aluminum profile segments attached by clad plates arranged perpendicularly giving rise to a very compact and light-weight configuration when it is in an operating mode.

18 Claims, 14 Drawing Sheets

(51) Int. Cl.

| | |
|---|---|
| ***F28F 9/02*** | (2006.01) |
| ***F28F 21/08*** | (2006.01) |
| ***F28D 7/16*** | (2006.01) |
| ***F28D 21/00*** | (2006.01) |
| ***F02M 26/32*** | (2016.01) |
| *F28D 9/00* | (2006.01) |
| *F28F 9/22* | (2006.01) |

(52) U.S. Cl.
CPC ..... *F28D 21/0003* (2013.01); *F28F 9/026* (2013.01); *F28F 9/0219* (2013.01); *F28F 21/084* (2013.01); *F28F 21/089* (2013.01); *F28D 9/0062* (2013.01); *F28D 9/0081* (2013.01); *F28F 2009/029* (2013.01); *F28F 2009/226* (2013.01); *F28F 2009/228* (2013.01); *F28F 2225/08* (2013.01); *F28F 2235/00* (2013.01); *F28F 2240/00* (2013.01); *F28F 2255/16* (2013.01); *F28F 2275/04* (2013.01)

(58) Field of Classification Search
USPC ..... 165/167
See application file for complete search history.

(56) References Cited

U.S. PATENT DOCUMENTS

| | | | | |
|---|---|---|---|---|
| 5,931,219 | A * | 8/1999 | Kull | F28D 9/005 165/166 |
| 6,298,910 | B1 * | 10/2001 | Komoda | B23K 1/0012 165/133 |
| 6,814,133 | B2 * | 11/2004 | Yamaguchi | F28D 9/0012 123/196 A |
| 2006/0000586 | A1 | 1/2006 | Katsumata et al. | |
| 2006/0201663 | A1 | 9/2006 | Strahle et al. | |
| 2008/0223562 | A1 | 9/2008 | Braic et al. | |
| 2008/0236792 | A1 | 10/2008 | Mast et al. | |
| 2009/0056922 | A1 | 3/2009 | Hemminger | |

FOREIGN PATENT DOCUMENTS

| | | |
|---|---|---|
| EP | 2159528 | 3/2010 |
| JP | 2007152422 | 6/2007 |
| JP | 2008196319 | 8/2008 |
| JP | 5468809 | 5/2014 |
| KR | 20070121805 | 12/2007 |
| WO | 2011061311 | 5/2011 |
| WO | 2011073038 | 6/2011 |

* cited by examiner

HEAT EXCHANGE DEVICE FOR EXCHANGING HEAT BETWEEN FLUIDS

OBJECT OF THE INVENTION

The present invention relates to a heat exchange device for exchanging heat between two fluids circulating through insulated conduits. In the preferred example the first fluid is a hot gas originating from an exhaust gas recirculation (EGR) system and the second fluid is a coolant liquid used for removing heat from the hot gas.

The device according to the invention has a simple and inexpensive construction, lacking a shell, giving rise to a very compact and light-weight configuration when it is in an operating mode.

BACKGROUND OF THE INVENTION

Heat exchangers for EGR systems formed by a stack of planar conduits where each of these planar conduits is formed by two steel sheets die-cut and welded to one another are known in the state of the art. In turn, inside each planar conduit there are corrugated sheets increasing the turbulence of the gas to be cooled and improving convection and therefore the transfer of heat to the coolant liquid circulating outside these conduits.

Planar conduits formed by die-cut and welded sheets having an embossment formed by embossing which favours the formation of channels or cavities between consecutive conduits for allowing the passage of the coolant liquid.

In such heat exchangers, the stack of conduits is housed in a shell which is what contains the coolant liquid. The shell is a structure which in turn has its inlet and outlet for the passage of the coolant liquid which removes the heat extracted from the hot gas. The volume of liquid in the shell comprises the volume between the planar conduits as well as the liquid between the shell and the stack of conduits where the latter is significant and increases the total weight of the device by a high percentage.

The experience of a person skilled in the art in the design of such exchangers cannot be extrapolated to other manufacturing methods and materials such as extruded aluminium. Not only are they materials with very different thermal conductivity and expansion coefficients, but the manufacturing and welding techniques are completely different and do not allow using the configurations used with stainless steel parts.

A type of aluminium plate called clad is known in the state of the art. Such aluminium plate in turn has a layer of aluminium with a melting point lower than the rest of the aluminium of the same plate on at least one of its surfaces. Throughout the description and the claims, when the term clad is used it will refer to such aluminium plate comprising a layer of aluminium with a melting point lower than the rest of the aluminium of the same plate on at least one of its surfaces.

The advantage of such plate is that it allows attachments with parts the surface of which contacts the surface with aluminium with a reduced melting point (reduced being understood as lower) by introducing them into an oven. The attachment process consists of subjecting the parts to be attached, including the clad plate, to a temperature greater than the melting temperature of the aluminium of reduced melting point but lower than the melting temperature of the rest of the aluminium.

At this temperature the aluminium of reduced melting temperature melts, attaching the contacting surfaces and the aluminium of higher melting temperature maintains structural integrity.

In the case in which it is necessary, for example, to attach two perpendicularly intersecting plates, in the state of the art the clad plate is elongated in a perpendicularly emerging segment so that the surface with the aluminium of reduced melting temperature of said segment contacts the other plate. The attachment is produced because the surface of this perpendicular segment having a lower melting temperature is parallel to the surface to be attached and contacts it. The passage through the oven for raising the temperature melts the aluminium contacting the part to be attached in particular, and it is assured that both plates, located perpendicular to one another, are welded.

The present invention provides a heat exchanger of a simple construction, lacking a shell, based on using extruded aluminium profiles the attachment of which is assured using clad plates used differently to how it is used in the state of the art. Other technical solutions combined with the foregoing are described in the following sections of the description.

DESCRIPTION OF THE INVENTION

The present invention is a heat exchanger with a simple construction, manufactured by means of extruded aluminium profiles, giving rise to a compact construction and using attachment means not known in the state of the art.

The device is a heat exchanger for exchanging heat between a first fluid, preferably a gas, circulating through a conduit and a second fluid, preferably a coolant liquid, circulating through a second conduit, where said device is intended for being intercalated between both conduits and according to the first claim comprises:

- a plurality of extruded aluminium profile segments such that:
  - they preferably extend according to a longitudinal direction,
  - they have one or more closed inner cavities giving rise to conduits in the longitudinal direction of the profile intended for conducting the first fluid; and where,
  - this plurality of segments are arranged distributed along a direction transverse to the longitudinal direction and spaced from one another, The profile segments are responsible for transporting the first fluid, for example hot gas, therethrough. These extruded aluminium profiles can be formed by cells guiding the gas and improving the transfer of heat from the first fluid to the outer surface of the profile. Various examples of structures in cells have been tested and it has been found that the cells based on straight inner walls are the most efficient. In this distribution in which there is a distance between profile segments, spaces which are intended for being occupied by the second fluid, the coolant fluid, are generated. As will be pointed out below, when all the basic components of the exchanger are introduced, these spaces generated by spacing are laterally closed by means of plates such that using a shell is not necessary.

- A first perforated or grooved clad aluminium plate, i.e., having a layer of aluminium with a melting point lower than the rest of the aluminium of the same plate on at least one of its surfaces, where the perforations or grooves are suitable for housing one of the ends of the plurality of profile segments such that said first plate is essentially perpendicular to such profile segments, and where such perforations or grooves have a configuration according to the section of the profile segments which they house, a second clad aluminium plate and a third clad aluminium plate where, the second plate is in the form of a perimetric ring and is intended for surrounding the plurality of profile segments, the third plate is perforated or grooved, where the perforations or grooves are suitable for housing the ends of the plurality of profile segments opposite the end where the first plate is located according to the longitudinal direction, and where such perforations or grooves have a configuration according to the section of the profile segments which they house, where both the second plate and the third plate are essentially perpendicular to such profile segments, The profile segments are spaced from one another due to the first aluminium plate and the third aluminium plate. The perforations or grooves of the first plate and the third plate house both ends of the profile segments assuring the relative position thereof.

The plates are clad plates and are arranged essentially perpendicular to the profile segments. This arrangement is not one which would be used in the state of the art for attaching a plate to a perpendicularly intersecting profile since at least one segment or flange emerging perpendicularly to the plate would be provided so that at least part of the surface of lower melting temperature of said plate would contact the profile segments.

In contrast, the invention makes both clad plates perpendicularly intersect the profile segment. The surface of the plate contacting the profile segment and with which the attachment is carried out is the surface generated in die-cutting. It has been proved through experiments that by establishing this attachment, the aluminium which is located on the free surface flows when it melts during the phase of passing through the oven and sufficiently wets the surfaces to be attached assuring the attachment and the leak-tightness, unlike what is considered in the state of the art.

This attachment allows the clad plate itself to be a structural element and to not require additional combined elements as occurs in the state of the art in which some assure the attachment and others provide strength; and therefore, the invention provides a much more light-weight device.

The end where the third plate is located is where the reinforcement formed by the second plate and the third plate is located; the end corresponding to the inlet of the hot gas and therefore is the area which can have more structural and hot spot problems. When operating in concurrent flow, this end is where the second fluid, which as mentioned also corresponds to the hot side where the inlet of the first fluid is located, is introduced. Since the end is hot, it is where the invention is configured, such that suitable distribution of the second fluid through all the cavities formed between the profile segments is favoured.

Notwithstanding the foregoing, although the invention has mainly been contrived for operating in concurrent flow, it has also been tested in countercurrent flow, finding that the performance and thermal fatigue strength are surprisingly good and even comparable because the configuration thereof continues to favour a good distribution of the coolant fluid in the inlet of the hot gas. Going from concurrent flow to countercurrent flow only implies that the direction of the flow between the so called inlet and the so called outlet of the coolant liquid is inverted in the device when it is use. This comment applies to all the embodiments of the invention.

According to particular embodiments, flow deflection elements also formed from clad plates which optimise the distribution of temperatures at the inlet of the second fluid, are incorporated.

However, embodiments which will be described with the aid of the drawings where there are established configurations suitable for preventing stagnation points in the second fluid and thus favouring using the device in applications with greater demands with respect to thermal fatigue are also object of this invention.

A first side clad plate and a second side clad plate extending between the first aluminium plate and the second aluminium plate and which are suitable for covering the sides of the profile segments defining intermediate chambers between consecutive profile segments.

These plates cover the flanks of the profile segments. They are clad plates which assure the attachment with the first profile segments by contacting their sides. These side plates close the spaces formed by the spacing between profile segments and extend between the first and the second plate.

The attachment between the side plates and the profile segments; and the attachment between the first plate, the second plate and the third plate with the profile segments is by means of melting the aluminium of lower melting point of the clad plates, At least these elements are linked by means of an attachment through clad plates with an essentially perpendicular intersection between parts to be attached resulting in one of the advantages of the invention, which is manufacturing the heat exchanger with a single passage of the assembly through the oven and a device with a very light-weight structure.

At the end of the profile segments according to the longitudinal direction where the third plate is located, the intermediate chambers between consecutive profile segments are in communication with a main chamber which in turn is in communication with connection means for the entry/exit of the second fluid; and, the device comprises connection means for connecting with the conduit of the second entering/exiting fluid, where such connection means with access to the intermediate chambers between profile segments; where these connection means allow intercalating the device in the conduit of the second fluid; and, the first plate and the third plate comprise connection means which allow intercalating the device in the conduit of the first fluid where the connection means of the third plate correspond to the inlet of the first fluid and the connection means of the first plate correspond to the outlet of the first fluid.

These connection means are those which allow the transfer of heat from the first fluid towards the second fluid. Choosing the inlet of the first fluid on the side where the second plate and third plate are located with a main distribution chamber allows the more critical hot areas to have an improved coolant liquid distribution area in the hot area reducing thermal fatigue.

The technical feature of providing inlet/outlet connection means for connecting with the conduit of the second fluid with access to the intermediate chambers between profile segments on the cold side is shown in all the embodiments by means of a simple solution consisting of a bulging in the side plate in the connection area. However, in all the cases it is possible to repeat the constructive solution of forming a chamber between two clad plates such as that carried out in the inlet of the first fluid in the opposite side, although this solution would be more expensive and unnecessary since the critical area would be the inlet of the first fluid, the hot side, since this is where the greatest demands with respect to thermal fatigue exist.

An EGR system which incorporates a heat exchanger such as the one described, and also a vehicle comprising said EGR system is also object of this invention.

Constructive details of the device as well as additional technical problems which are solved using an embodiment are described in the following section.

DESCRIPTION OF THE DRAWINGS

These and other features and advantages of the invention will become more apparent from the following detailed description of the preferred embodiments given only by way of illustrative and non-limiting example in reference to the attached drawings.

DETAILED DESCRIPTION OF THE INVENTION

The invention is described in a more detailed manner using three embodiments containing, in addition to the essential technical features, other features each giving rise to a shell-less device which can mostly be manufactured by means of welding by passing through an oven to attach the clad parts and which is lightweight in operating mode. Some of the parts, especially when they have a high Mg content are able to be welded for example by means of CMT or TIG welding.

In the three embodiments it is considered that the first fluid to be cooled is a hot gas which originates from a combustion engine and which will be reintroduced into the intake manifold according to an EGR system after being cooled. The coolant fluid is a liquid responsible for removing heat from the hot gas. Both fluids are transported by means of conduits between which the device is intercalated for transferring the heat of the hot gas to the coolant liquid.

However, this is not the only application of this heat exchanger. The first embodiment of the invention, for example, is particularly light-weight and suitable for cooling hot gas which is not at a temperature as high as that of the EGR gas. This is the case of the gas compressed in two steps in a turbo-charged engine. An intermediate cooling is required to go from the first compression step to the second compression step for reducing its density. The first embodiment solves this technical problem by providing a particularly compact and light-weight heat exchanger.

Figure 1:
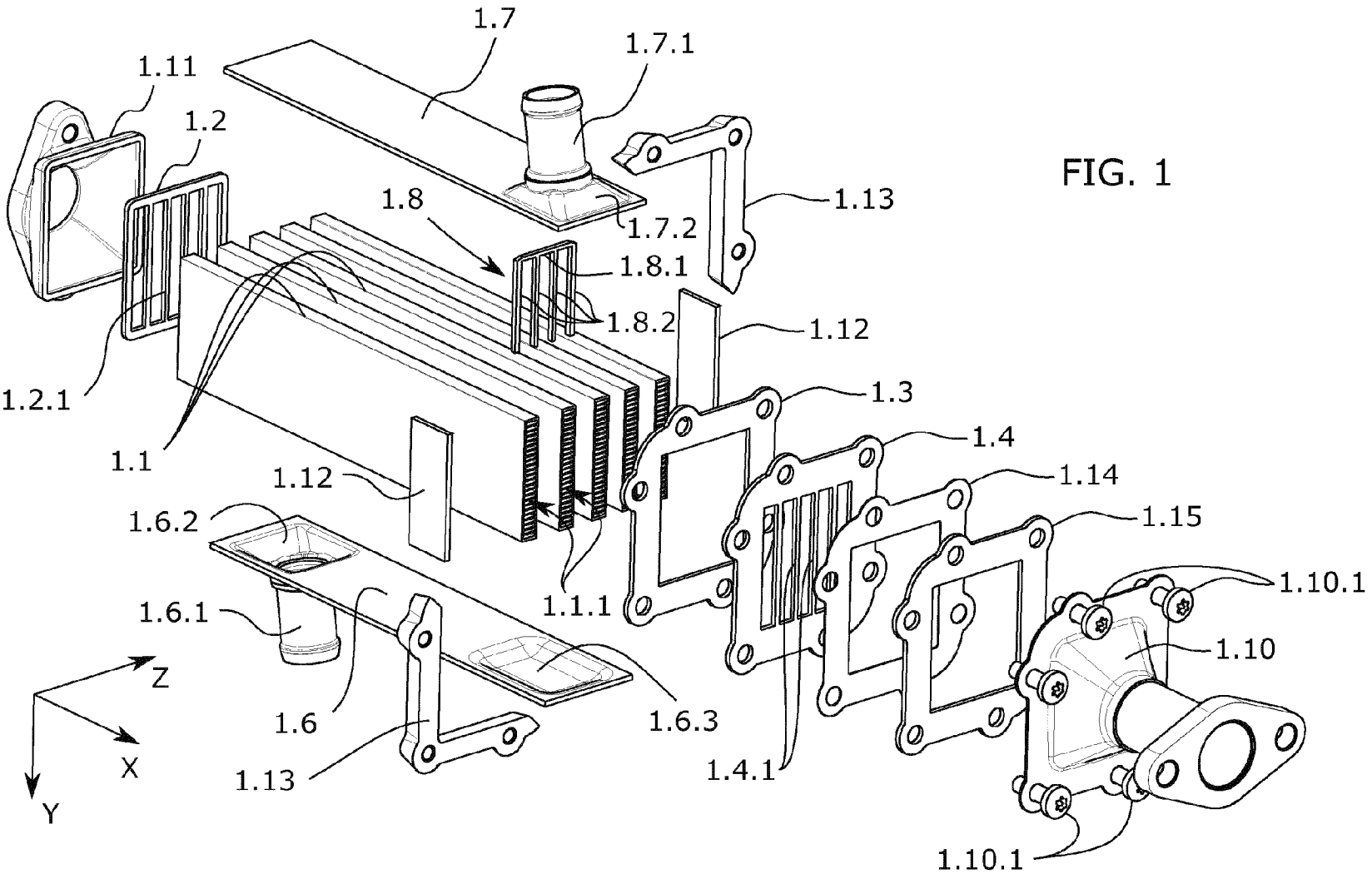
FIG. 1 shows an exploded perspective view of the set of components of an exchanger according to a first embodiment.

The device according to this embodiment is shown by the components in the exploded perspective view of FIG. 1. This figure can be combined with FIGS. 2 and 3 to see the inside of the device once assembled.

The main structure comprises a plurality of extruded aluminium profile segments (1.1) showing a cell structure (1.1.1) intended for the passage of the gas to be cooled therein.

In this embodiment the profile segments are configured according to a rectangular section and are arranged parallel and spaced from one another leaving a space which in an operating mode is occupied by the coolant liquid.

The attachment between profile segments (1.1) is assured by three plates, a first plate (1.2), a second plate (1.3) and a third plate (1.4).

The parallel arrangement between profile segments (1.1) and the spacing therebetween is mainly defined by the two plates arranged at the ends: the first plate (1.2) and the third plate (1.4). These plates (1.2, 1.4) have perforations (1.2.1, 1.4.1) corresponding with the section of the profile segments (1.1) such that the ends of the profile segments (1.1) are housed in said perforations (1.2.1, 1.4.1) after the assembly.

The perforations (1.2.1, 1.4.1) can preferably be obtained by means of die-cutting. The surfaces generated by die-cutting are those contacting the perimetric surface of the end of the profile segment (1.1) corresponding to the plate (1.2, 1.4) housing said end.

The second plate (1.3) is ring-shaped given that it is die-cut for coinciding with the perimetric configuration of the assembly of profile segments (1.1). In this case the perimetric shape is rectangular.

The spaces between the profile segments (1.1) are laterally closed by means of a first (1.6) and second (1.7) side clad plate. These side plates (1.6, 1.7) longitudinally elongate from the first plate (1.2) to the second plate (1.3); and transversely extend enough so as to cover the openings between the profile segments (1.1) to thus form inner chambers for the passage of the coolant liquid.

According to this embodiment, the entry and exit of the coolant liquid has been simply achieved generating, by forming, a conical area (1.6.2, 1.7.2) on the elongated side plates (1.6, 1.7) by means of connecting the inlet (1.7.1) and outlet (1.6.1) of the coolant liquid.

The conical configuration allows the inlet conduit and outlet conduit to be in communication with all the cavities arranged between the profile segments (1.1). In this embodiment, using clad plates with the aluminium surface of reduced temperature oriented towards the group of profile segments (1.1) allows the leak-tightness of all the contacting surfaces and particularly of the coolant liquid circuit.

In the case of the conical configuration (1.7.2), a coolant liquid distribution chamber (C) allowing the homogenous entry of flow into all the intermediate chambers between the profile segments (1.1) is internally obtained in the side plate (1.7) corresponding to the inlet conduit.

The other leak-tight attachments which are attached are those corresponding to the die-cut surfaces of the perforations (1.2.1, 1.4.1) of the first plate (1.2) and third plate (1.4), as well as the inner rectangular perforation of the second plate (1.3) with the outer surfaces of the group of profile segments (1.1). The three clad plates (1.2, 1.3, 1.4) perpendicularly intersect with the group of profile segments (1.1); nevertheless, it has been proven that the aluminium adjacent to the contact area of the wet profile segments (1.1) melts when passed through the oven and that the attachment of the die-cut area and the profile segment (1.1) is assured after cooling.

The hot gas enters through the same end of the exchanger in which the coolant liquid inlet is located when used in concurrent flow. The hotter end is thus cooled by the coldest liquid. When used in countercurrent, the hot gas inlet contacts an area where the coolant has a homogenous distribution. In both cases the possibility of hot spots is reduced.

The hot gas enters through a conical-shaped intake manifold (1.10). This first embodiment has a particularly lightweight structure therefore the attachment with the intake manifold (1.10) has been reinforced. The intake manifold (1.10) is usually made of stainless steel. In this embodiment, instead of screwing the intake manifold (1.10) with a stiff part, given that the attachment of the second and third aluminium plates (1.3, 1.4) is not stiff enough, it is screwed to a pair of L-shaped stiffening parts (1.13) arranged on the other side of the assembly of plates formed by the second plate (1.3), the third plate (1.4) and an attachment gasket (1.14). In this embodiment, an additional fourth plate (1.15) made of stainless steel which is welded to the intake manifold (1.10) has been incorporated to assure the support of the attachment gasket (1.14) with the seat of the intake manifold (1.10)

The shape of the L-shape parts (1.13) which are two in number allow the insertion after having weld the components of the heat exchanger such that each L-shaped part (1.13) enters through one side until it is located behind the bundle formed by the second plate (1.3), third plate (1.4) and fourth plate (1.15) and the gasket (1.14). The four elements are not stiff enough for the attachment, therefore the stiff L-shaped parts (1.13) assure a good attachment with the intake manifold (1.10) by means of screws (1.10.1).

The gas exits at the opposite end, where an outlet manifold (1.11) collects the gases which have passed through each of the profile segments (1.1). In this embodiment, the manifold (1.11) is an aluminium moulded part suitable for encircling or at least housing the ends of the profile segments (1.1). The first plate (1.2) is not flush with the ends of the profile segments (1.1), but is slightly out-of-flush so as to allow fitting the manifold (1.11) coinciding with the perimetric shape of the group of profile segments (1.1). The position of the first plate (1.2) is such that the manifold (1.11) contacts the side surface of the first plate (1.2) at least in its perimetric edge. When the manifold (1.11) is made of moulded aluminium with a high Mg content the manifold (1.11) and the first plate (1.2) can be attached by means of CMT welding or alternatively by TIG welding.

In this embodiment, ancillary clad plates (1.12) have been used arranged on the outer face of the externally arranged profile segments (1.1) that are tightly fitted in its edge to the third plate (1.4). This solution is applicable to those points of the perpendicular attachment to be reinforced. To a larger extent, it can also assure the leak-tightness of the attachment since the melting in the tight fitting edge of the ancillary plate (1.12) contributes to the improved attachment of the third plate (1.4) located perpendicularly.

Figure 2:
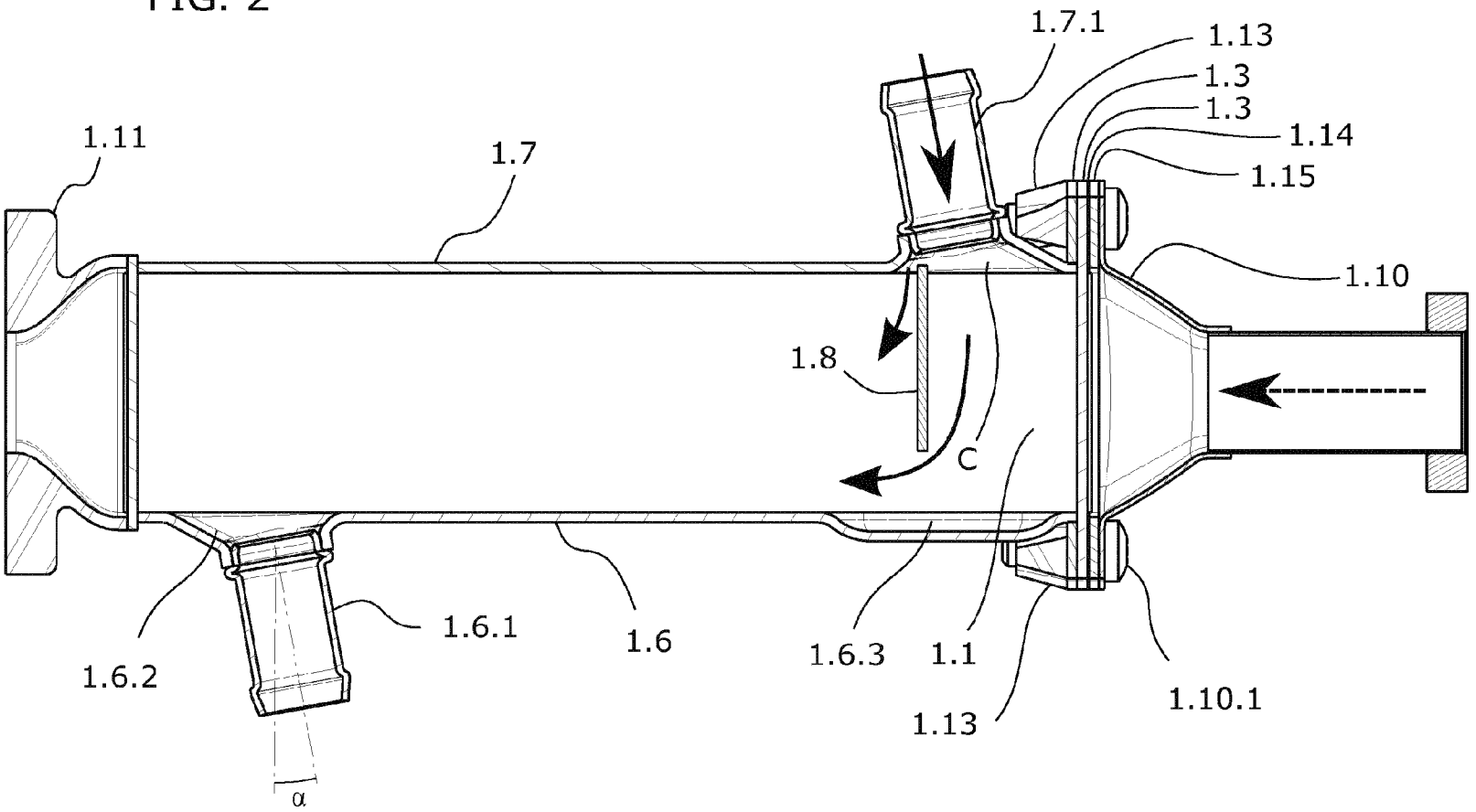
FIG. 2 shows the same first embodiment where a longitudinal section according to a plane parallel to the profile segments between which the intermediate chambers are defined is depicted.
Figure 3:
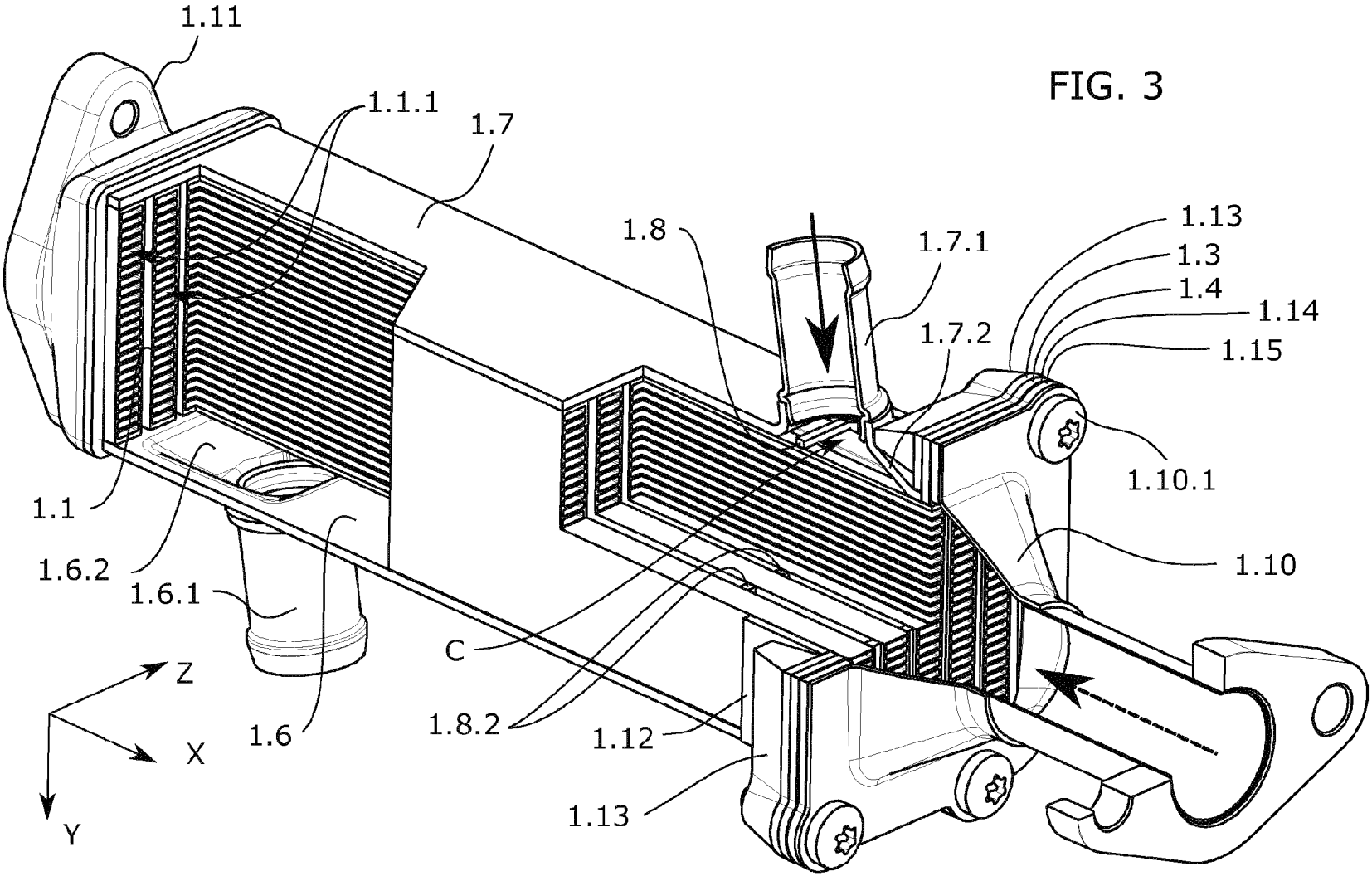
FIG. 3 shows the same first embodiment where a perspective view of the device once assembled and with quarter sections that allow seeing the inner configuration at the two ends, at the inlet and at the outlet of the second fluid, the coolant liquid, in detail.
Figure 4:
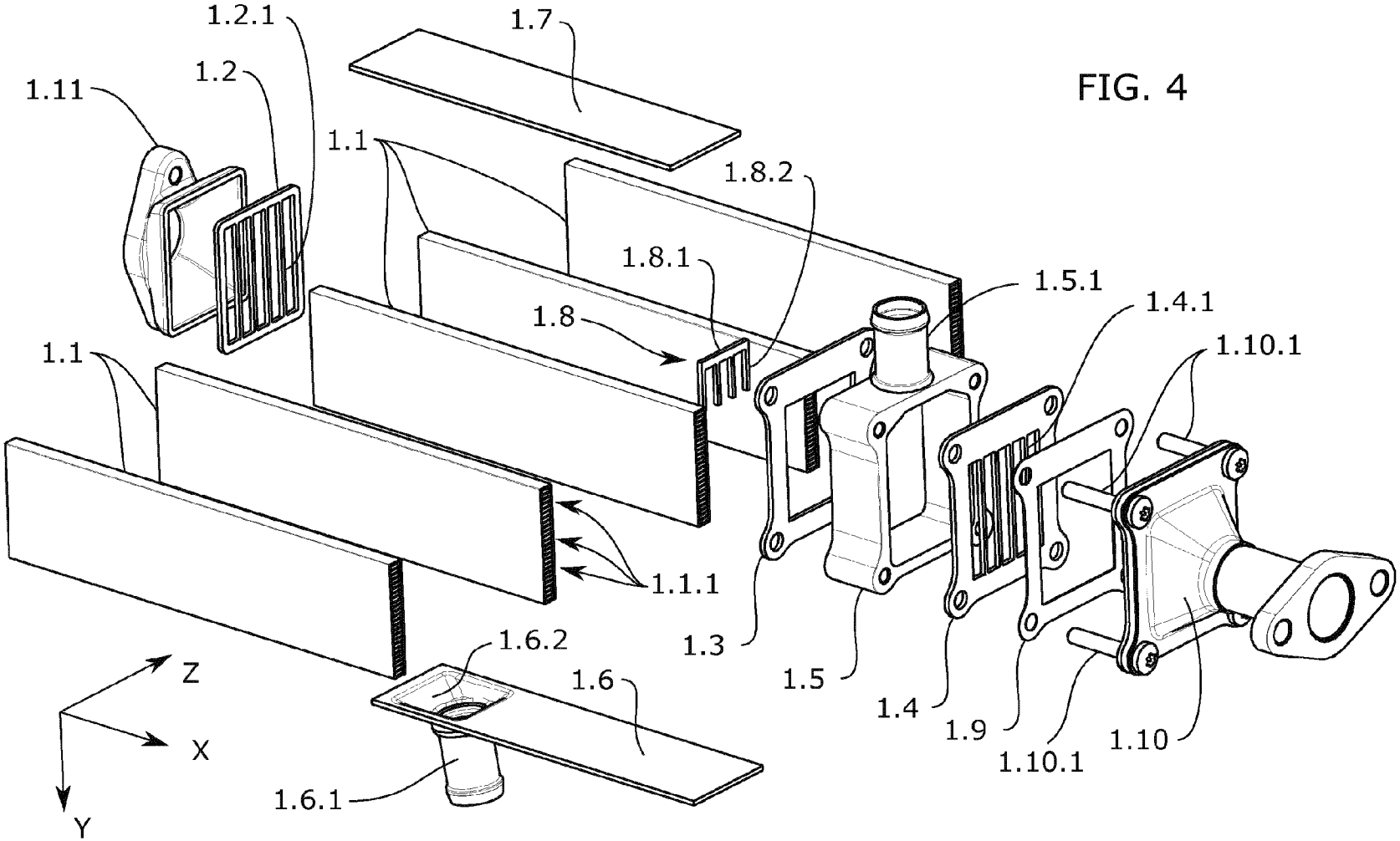
FIG. 4 shows an exploded perspective view of the set of components of an exchanger according to a second embodiment.
Figure 5:
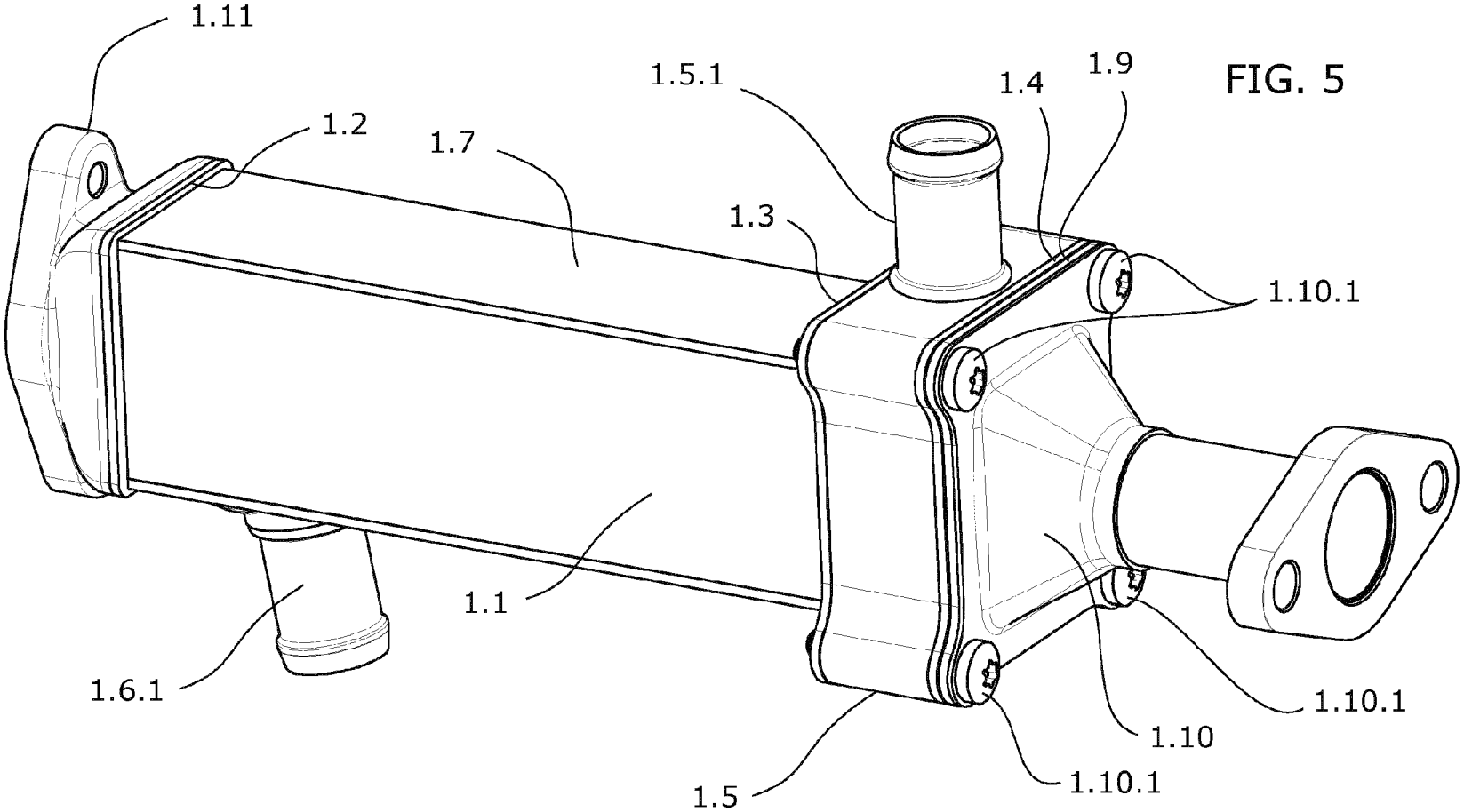
FIG. 5 also shows a perspective view of the same second embodiment, with the components assembled.

In view of FIG. 2, when the heat exchanger operates in concurrent flow, it can be observed that the incoming coolant liquid, after passing through the main chamber (C), is forced to move downwards (according to the orientation of the figure) until reaching the opposite corner of the intermediate chambers formed between profile segments (1.1) as a result of the presence of a deflector (1.8), to then be diverted in order to flow longitudinally along the space between profile segments (1.1). The direction of the flow is indicated using arrows with solid thick line.

The lower right corner which is shown in FIG. 2 can be a stagnation region, hence a comb-shaped flow deflector (1.8) formed by a main body (1.8.1) and prolongations (1.8.2) has been incorporated in this embodiment. This part has been obtained by die-cutting a clad plate. The main body (1.8.1) of the deflector is located on the profile segments (1.1) and the prolongations (1.8.2) extend vertically forcing the flow towards the stagnation region for preventing this almost non-existent flow region and therefore preventing hot areas. The part of the deflector (1.8) obtained by die-cutting a clad plate allows being positioned as has been indicated and allows giving rise to an attachment with the adjacent profile segments (1.1) due to the passage thereof through the oven. In other words, the attachment is produced between the main body and the upper faces of the profile segments (1.1) on which it rests; and also on the side contact surfaces between the profile segments (1.1) and the prolongations (1.8.2).

According to this embodiment, the deflector (1.8) is located parallel to the second plate (1.3); nevertheless, there are embodiments, which can also be combined with those that will be described below, in which arranging this part (1.8) obliquely is of interest or it can even adopt degrees of curvature which allow modifying the flow which is to be imposed in the inlet of the coolant liquid.

In this embodiment, a specific distance has also been maintained between the start of the chamber (C) and the deflector (1.8) since a part of the entering flow passes through the rear part of the deflector (1.8) thus preventing the deflector from giving rise to stagnation points prone to generating thermal fatigue for example because areas reaching boiling temperatures are produced.

In this embodiment, the outlet of the coolant liquid has been arranged with an inclination ($\alpha$). Adopting angles of inclination also modifies the configuration of stagnation areas. Adopting this angle ($\alpha$) allows reducing the stagnation region located at the same end but in the corner of the opposite side, which is shown in the upper left in FIG. 2.

FIGS. 4 to 7 show a second embodiment in which compared with the first embodiment it primarily modifies the inlet of the second fluid, the coolant liquid, for reducing the existence of stagnation areas preventing hot spots. This second embodiment is suitable for applications where the temperature of the first fluid is higher as occurring in an EGR gas and it has been proven that the number of thermal cycles which the device can withstand increases with respect to the first embodiment by one order of magnitude.

In this embodiment, the same structure as in the first embodiment is reproduced in the profile segments (1.1), in the enclosure established by the side plates (1.6, 1.7) and in the attachment solution at the end of outlet of the first fluid where the outlet manifold (1.11) is located.

The changes are mainly seen at the side where the first fluid, the hot gas, is admitted. According to this embodiment, the second plate (1.3) and the third plate (1.4) are separated from one another by means of a tubular distribution body (1.5). This tubular distribution body (1.5) surrounds the end of the group of profile segments (1.1) in which the second (1.3) and third plate (1.4) are located.

In this embodiment, the tubular distribution body (1.5) defines the chamber (C) therein between its inner walls and the end portion of the profile segments (1.1) located between the second plate (1.3) and third plate (1.4). The spaces existing between the profile segments (1.1) intended for the passage of the coolant liquid even exist in the end portion between the second plate (1.3) and third plate (1.4). The chamber (C) communicates all the spaces or intermediate chambers between profile segments (1.1) facilitating the distribution of coolant liquid after entering the chamber (C).

This chamber (C) has a connection (1.5.1) for allowing connection with the coolant liquid conduits. This connection (1.5.1) corresponds to the coolant liquid inlet when the exchanger operates in a concurrent flow. In this configuration it has particularly been observed that the device has great thermal fatigue strength in countercurrent due to the improved distribution of the coolant liquid in the hot area despite it being slightly hotter.

The connection means (1.5.1) for connecting with the tubular distribution body (1.5) have the inlet contained in a plane parallel to that main plane defined by the profile segments (1.1). This configuration allows making the entry direction of the flow coincide with the direction of the cavities formed between consecutive profile segments (1.1).

Figure 7:
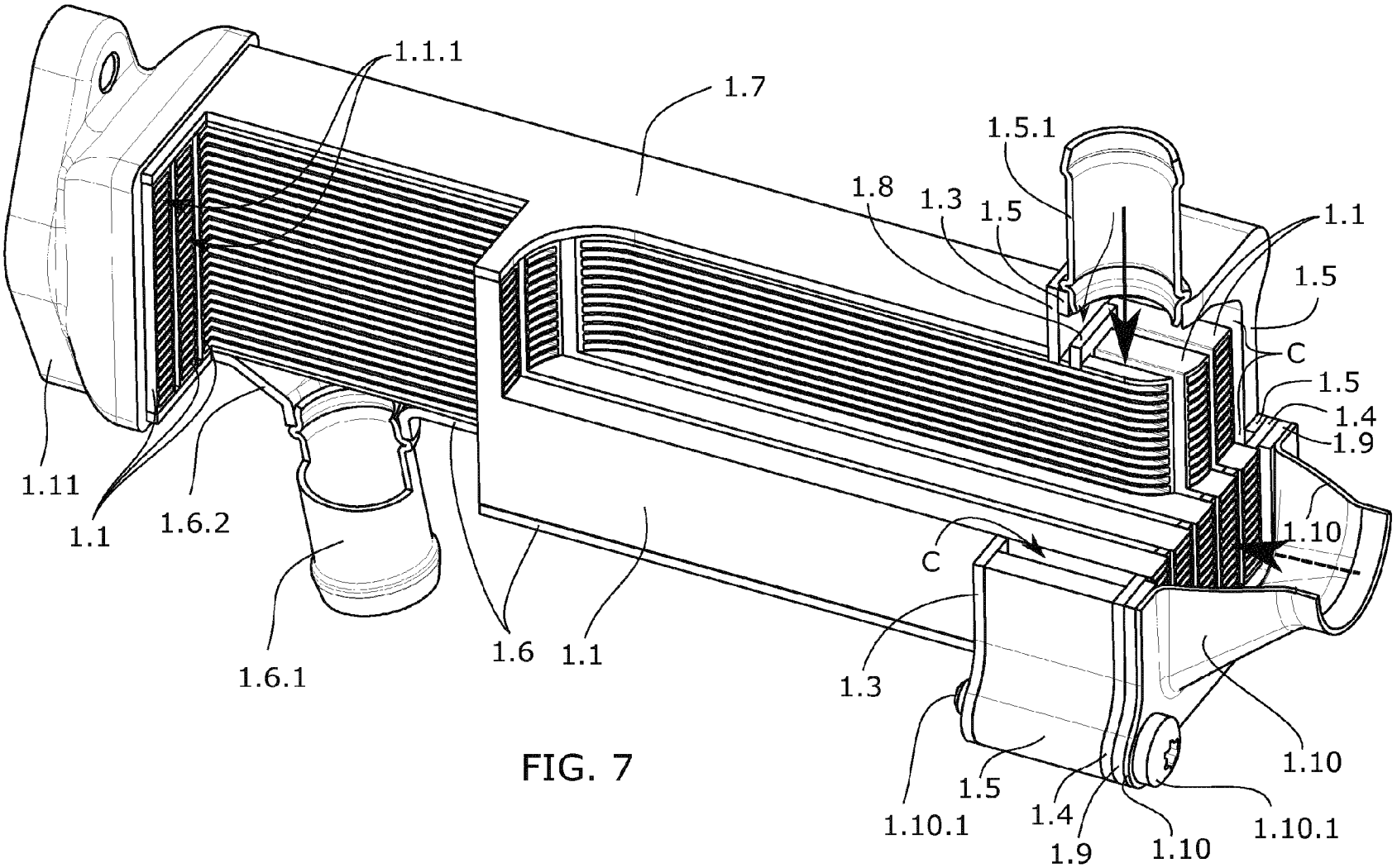
FIG. 7 shows a perspective view of the same second embodiment after having applied two partial sections, a first section and a quarter section at the inlet of the second fluid and another section removing the volume corresponding to a prism for allowing visual access to the outlet of the second fluid.
Figure 8:
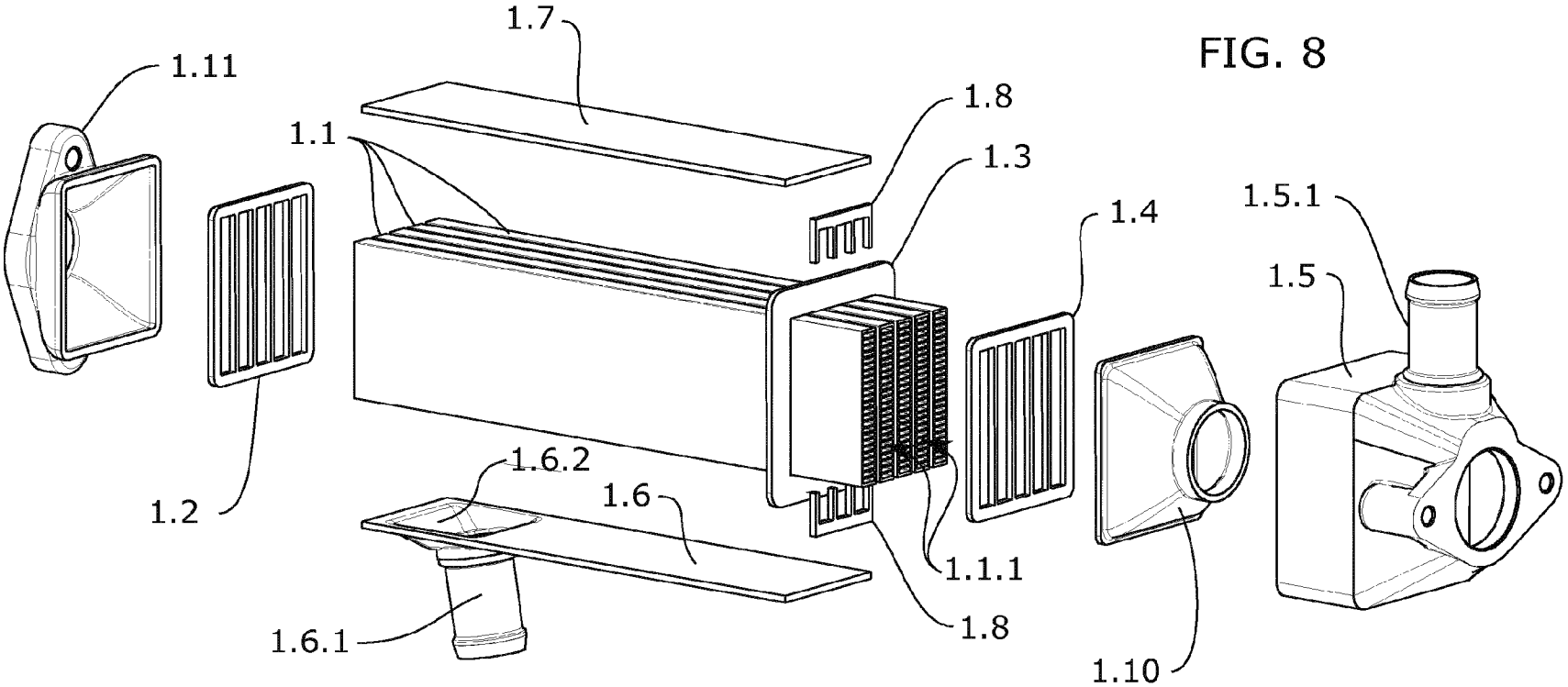
FIG. 8 shows an exploded perspective view of the set of components of an exchanger according to a third embodiment. In this embodiment the configuration of the distribution chamber of the coolant liquid has been modified.
Figure 9:
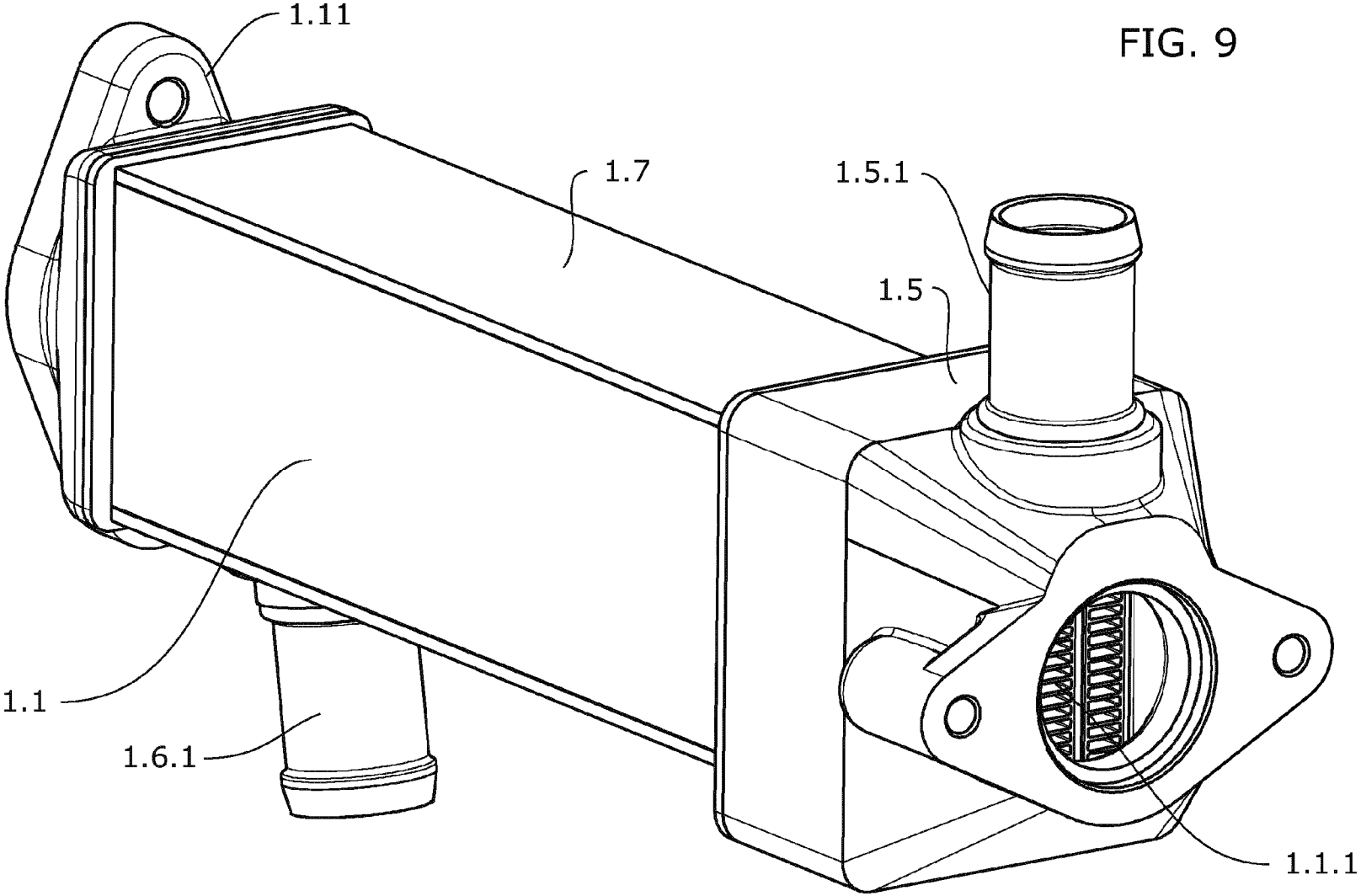
FIG. 9 shows the same third embodiment where a perspective view of the device once assembled is shown.
Figure 10:
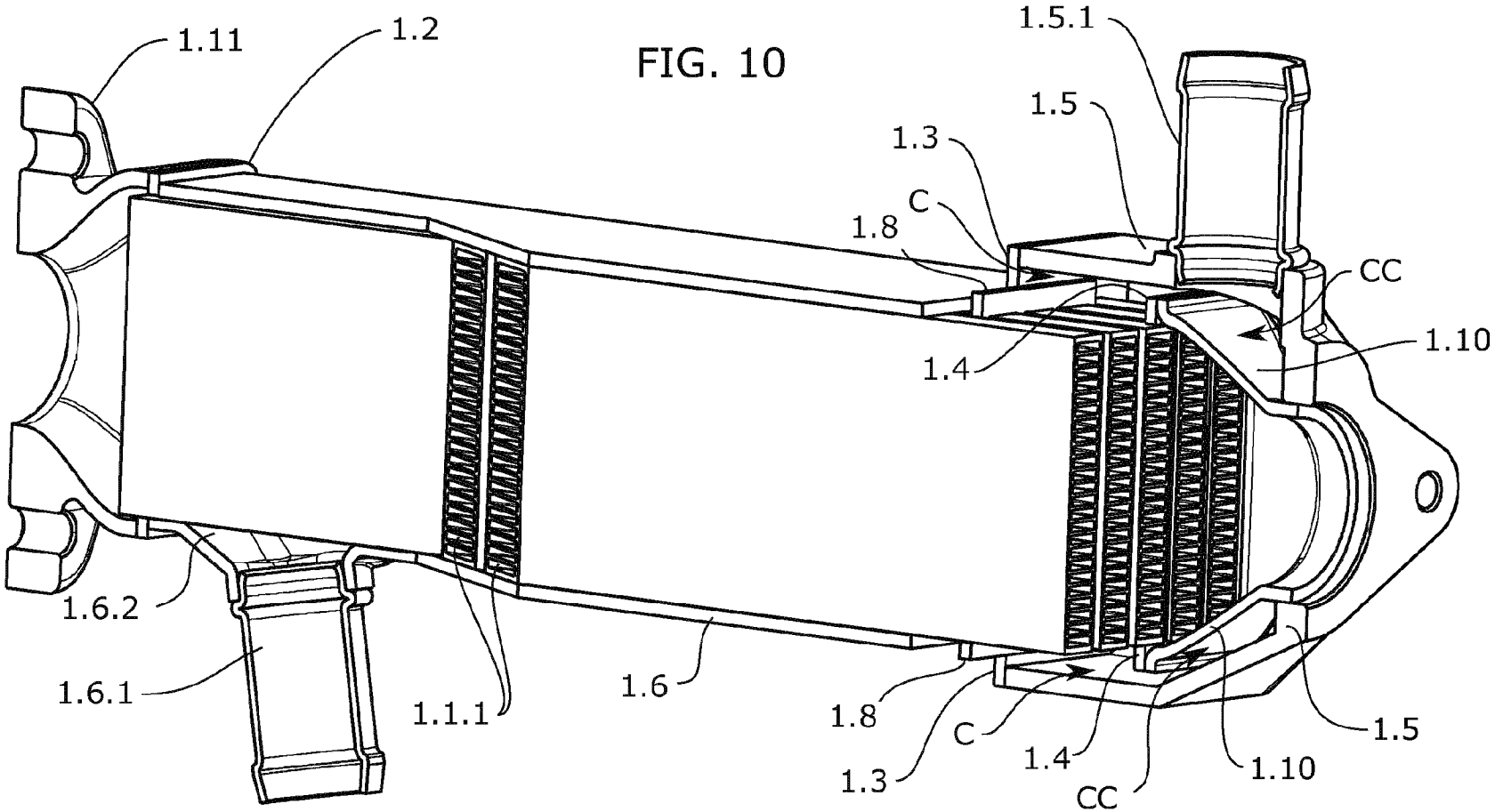
FIG. 10 shows a perspective view of the same third embodiment and with a broken longitudinal section which allows observing the inner structure of the device.

The configuration of the chamber (C) and how it allows distributing coolant liquid in each of the spaces defined between profile segments (1.1) is clearly shown to the right of FIG. 7. The flow of coolant liquid, when use in a concurrent flow, is depicted with an arrow with solid thick line. The entry flow has direct access to each of the spaces defined between the consecutive profile segments (1.1). Nevertheless, unlike the first example, the chamber (C) also extends perimetrically and allows a side flow which also allows access from the lower position eliminating stagnation areas which would easily give rise to hot spots damaging the device.

Likewise, the deflector (1.8), given that the chamber (C) is defined between the second plate (1.3) and the third plate (1.4), is slightly spaced from the second plate (1.3) for allowing a small portion of flow to pass behind eliminating possible stagnation areas caused by the deflector (1.8).

Figure 6:
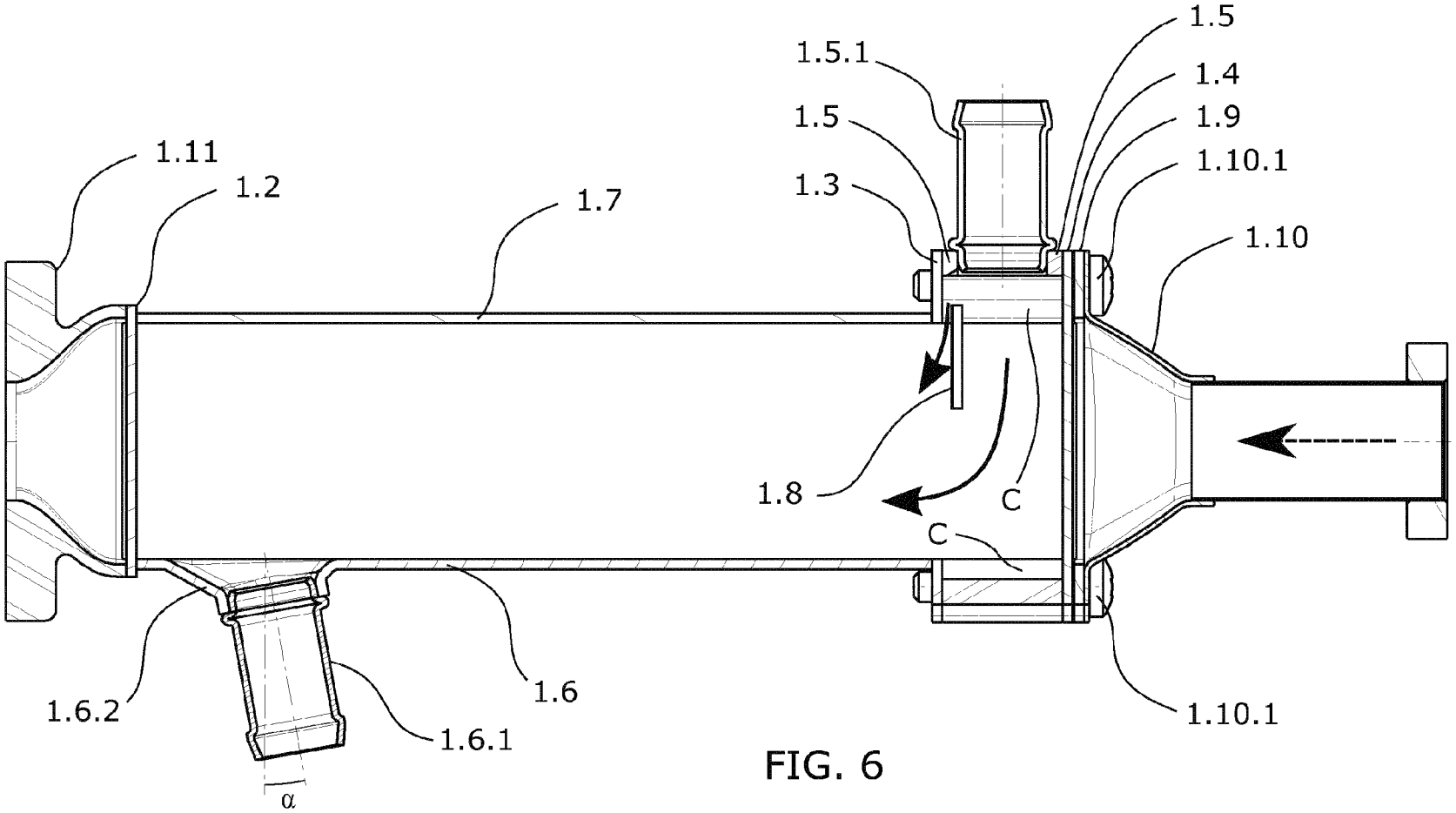
FIG. 6 shows the same second embodiment, where a section is depicted according to a plane passing through the central axis and parallel to the plurality of profile segments for showing the configuration according to the same embodiment of the inner chambers and the deflection of the flow of the second fluid to the inlet thereof.

With respect to the first fluid, the gas to be cooled, it enters through the openings of the ends of the profile segments (1.1) according to the direction indicated to the right of FIGS. 6 and 7 by means of an arrow with thick dotted line.

The third plate (1.4) prevents the communication between the inner chamber (C) with the coolant liquid and the space where the hot gas is located since the perforations (1.4.1) housing the ends of the profile segments (1.1) coincide with the segment thereof and the attachment with the third clad plate as described above.

In this second embodiment, the connection with the gas conduit is established by means of a conical-shaped intake manifold (1.10) adapting the tubular configuration of the gas conduit with the perimetric configuration of the assembly formed by the second plate (1.3), the tubular intake body (1.5) and the third plate (1.4). The block formed by these three elements (1.3, 1.5, 1.4) has four screws (1.10.1) for attaching with the intake manifold (1.10). In this embodiment, the screws (1.10.1) traverse the block formed by the three parts identified above: the second plate (1.3), the tubular intake body (1.5) and the third plate (1.4). The seat of the intake manifold (1.10) has of a gasket (1.9) assuring the leak-tightness in the screwed attachment of the intake manifold (1.10). Since the tubular distribution body (1.5) in this embodiment is a stiff enough body, a reinforcement such as the L-shaped parts (1.13) described in the first embodiment is not necessary.

FIGS. 8, 9, 10 and 11 show a third embodiment which, compared to the first and second examples, shows a modified inlet area of the first fluid, the hot gas.

In this embodiment, there is also a second clad plate (1.3) and a third clad plate (1.4) arranged at the end opposite the end where the first clad plate is located; and such plates are spaced from one another leaving a portion of the ends of the profile segments (1.1) therebetween. When operating in a concurrent flow, the coolant liquid enters between these two plates (1.3, 1.4) and along the entire perimeter.

In this embodiment, there is also a tubular distribution body (1.5) defining the chamber (C) which allows distributing the coolant liquid along the periphery of the portion of the ends of the profile segments (1.1) exposed to this chamber (C); nevertheless, this tubular distribution body (1.5) extends beyond the third plate (1.4) from the second plate (1.3).

Figure 11:
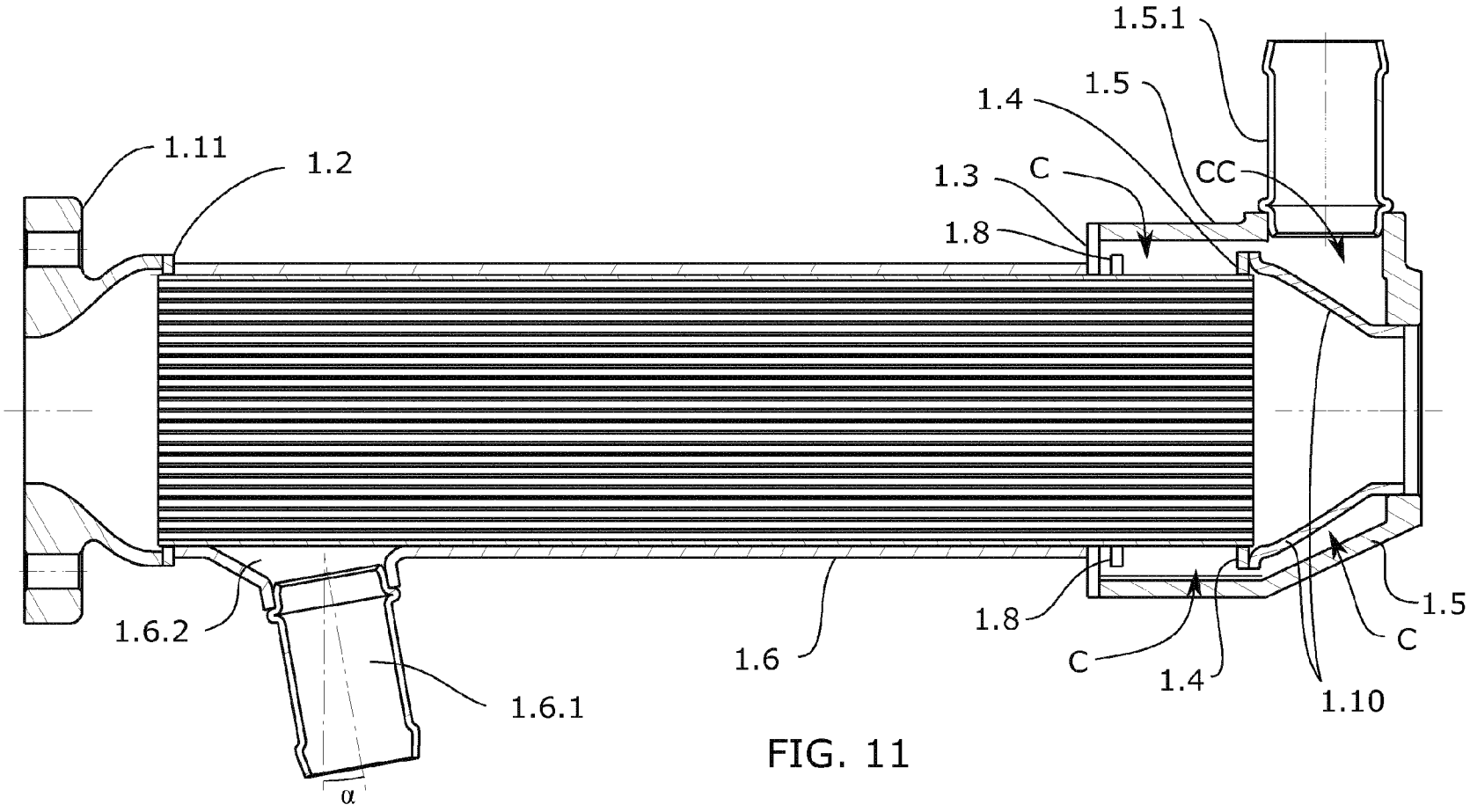
FIG. 11 shows an elevational section view of the same third embodiment where the configuration of the distribution chamber for distributing the second fluid which in turn houses the intake manifold of the hot gas is highlighted.

As seen in detail in the section of FIG. 11, given that the intake manifold (1.10) is coupled to the third clad plate (1.4) for directing the flow of hot gas to the closed inner cavities (1.1.1) of the profile segments (1.1) from the gas inlet conduit and, the elongation of the tubular distribution body (1.5) establishes a second chamber (CC) so that this gas is not in communication with the coolant liquid distribution chamber (C).

This second chamber (CC) is mainly located between the tubular body (1.5) and the intake manifold (1.10), now arranged internally, for allowing the perimetric distribution of the coolant liquid. When the exchanger is used in a concurrent flow, it is be observed that the coolant liquid enters through the connection means (1.5.1) located in communication with the second chamber (CC) instead of with the first chamber (C). This distribution has the technical effect of cooling the gas which is still in the intake manifold (1.10) even before reaching the closed inner cavities (1.1.1) of the profile segments (1.1) with the coolant liquid of lower temperature.

The coolant liquid goes into the first chamber (C) once it has reduced the temperature of the gas in the intake manifold (1.10). This is possible because the second chamber (CC) and the main chamber (C) are communicated with one another for transferring the coolant liquid distributed perimetrically in the second chamber (CC) towards the main chamber (C). This communication is essentially according to a longitudinal direction (X) such that the perimetric flow of the coolant liquid which in the second embodiment was towards the second plate (1.3) and the third plate (1.4), is now carried out in the second chamber (CC). Therefore, given that the section of the second chamber (CC) imposing the intake manifold (1.10) is greater, the perimetric distribution of the flow of coolant liquid is better and once it has been distributed perimetrically it goes to the first chamber (C) where it is still allowed to flow perimetrically, if necessary.

As in preceding examples, deflectors (1.8) have also been used in this embodiment, in particular two deflectors arranged opposite one another, and slightly spaced from the second plate (1.3) for preventing stagnation areas.

Figure 12:
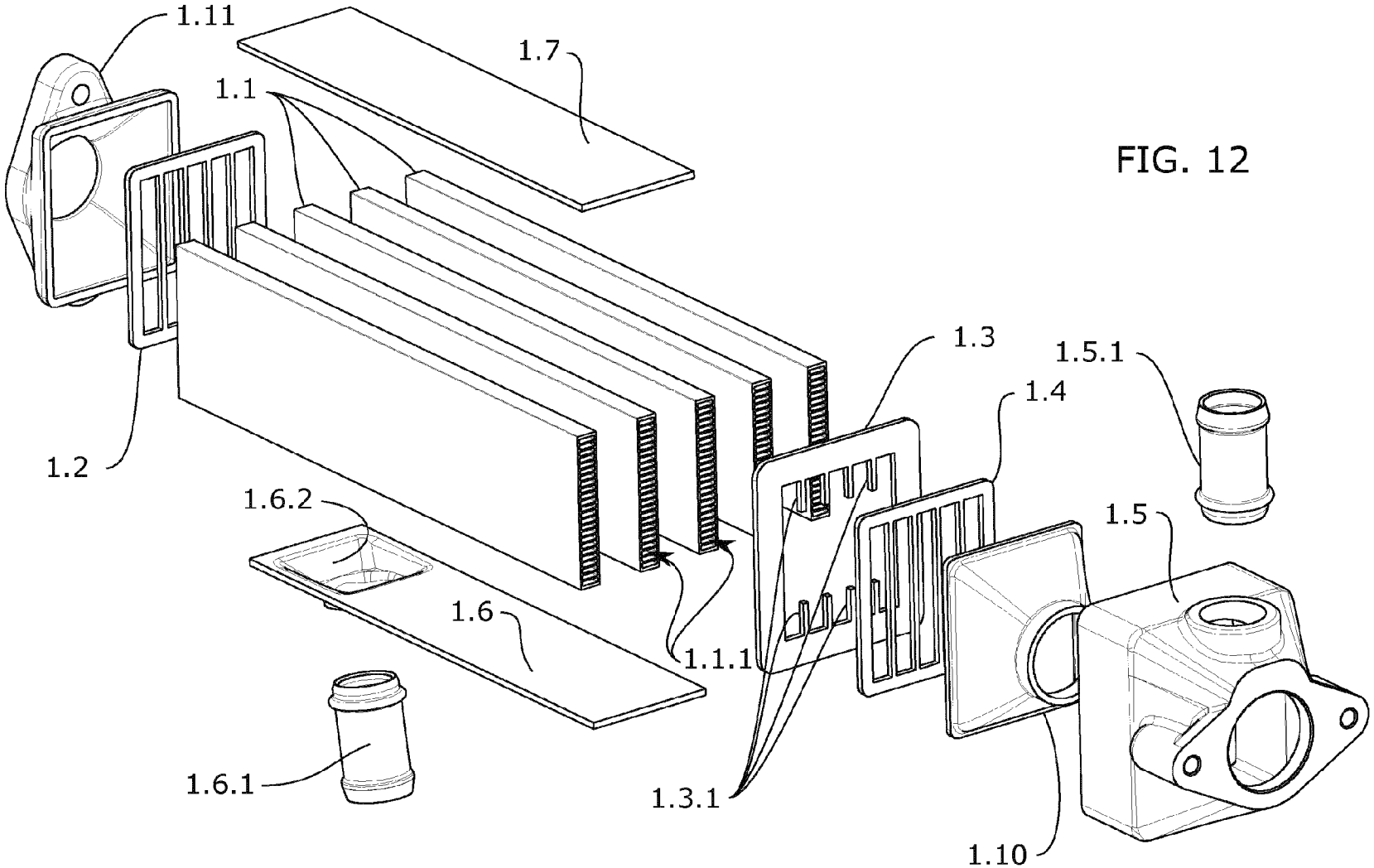
FIG. 12 shows an exploded perspective view of the set of components of an exchanger according to a forth embodiment. In this embodiment the configuration of the deflector element has been modified.
Figure 13:
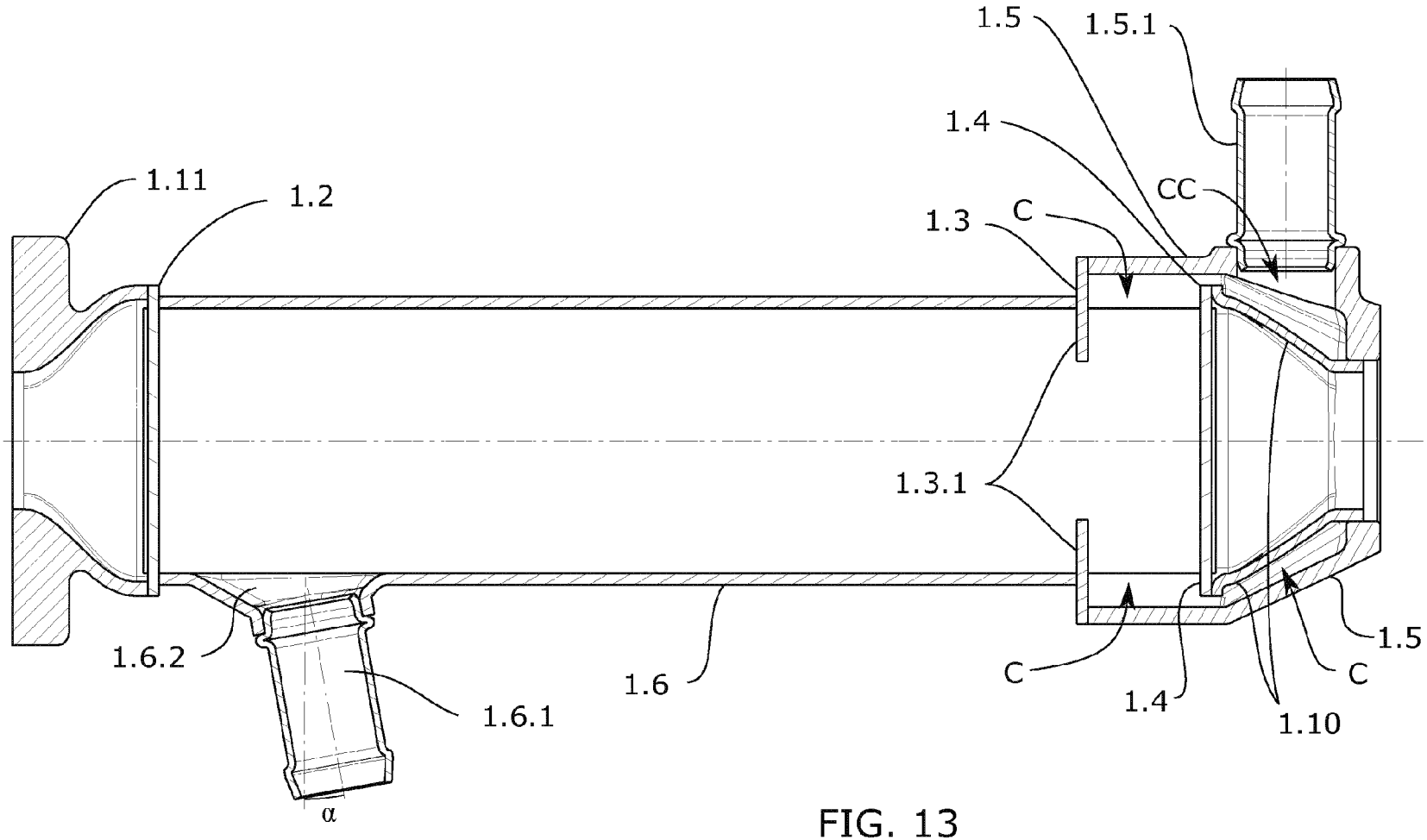
FIG. 13 shows the same forth embodiment where a section is depicted according to a plane passing through the central axis and parallel to the plurality of profile segments for showing the configuration according to the same embodiment of the inner chambers and the deflection of the flow of the second fluid to the inlet thereof.
Figure 14:
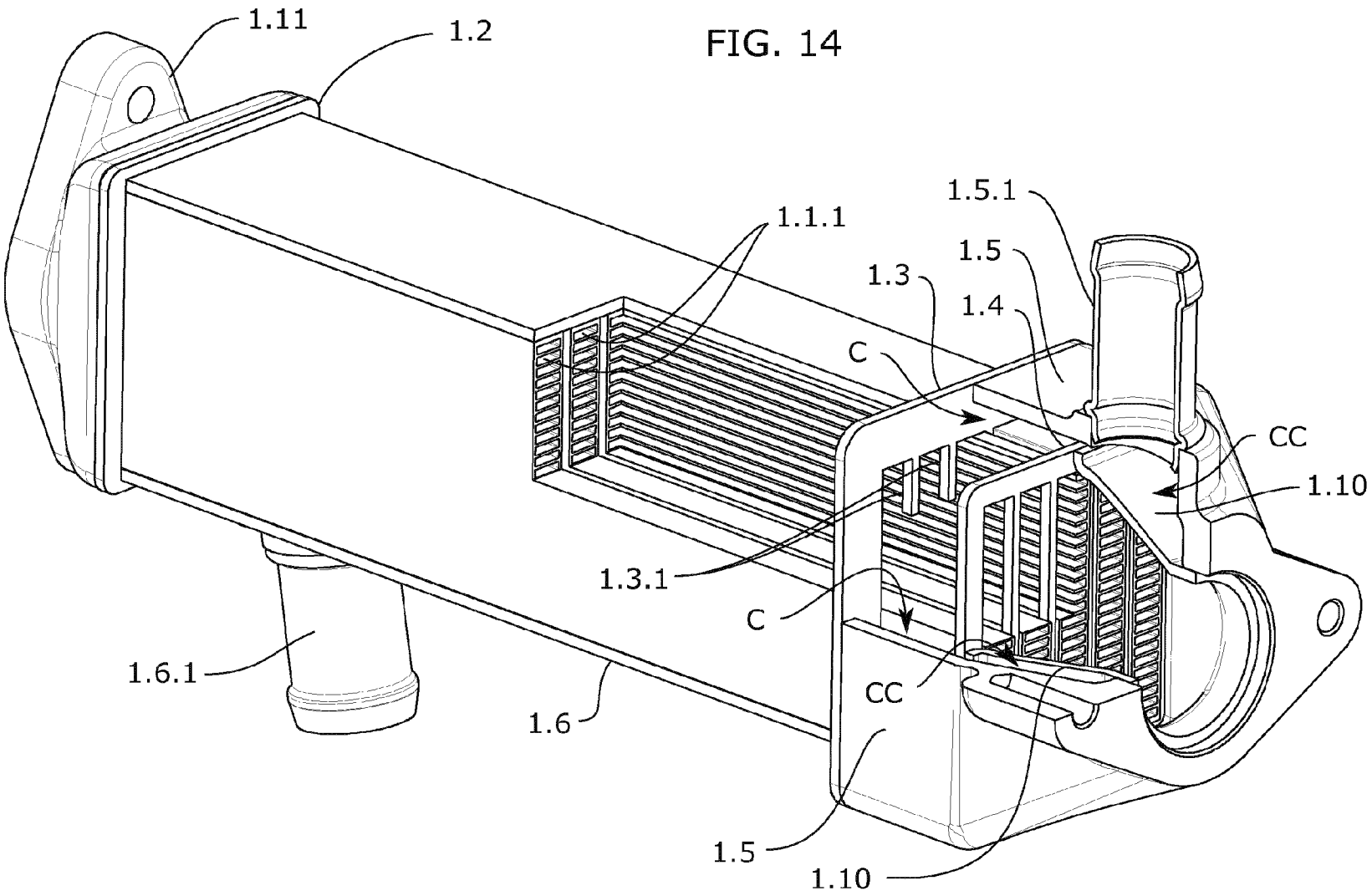
FIG. 14 shows a perspective view of the same forth embodiment after having applied a partial section at the inlet of the second fluid allowing visual access to the two chambers.

FIGS. 12, 13 and 14 show a forth embodiment which, compared to the third example, shows a modified deflector (1.3.1). The third embodiment shows a ring shaped second plate (1.3) surrounding the bundle of profile segments (1.1) so this plate do not modify the velocity field within the space defined between the profile segments (1.1). The deflector (1.8), as disclosed above, prevents from giving rise the stagnation points prone to generating thermal fatigue since a part of the entering flow passes through the rear part of the deflector (1.8) distanced from the second plate (1.3).

This third example requires two separated pieces, the second plate (1.3) and the deflector (1.8) wherein the deflector (1.8) needs extra effort when ensuring its position before entering into the oven.

The forth embodiment only requires one piece, a modified second plate (1.3) comprising internal prolongations having the functionality of the deflector (1.3.1) which partially enter between the profile segments (1.1).

It has been tested that, when the exchanger is used in countercurrent, the hottest point within the second fluid is located at the stagnation point located adjacent to the third plate (1.4); therefore, in some particular conditions, the stagnation point behind the deflector (1.3.1) is not the critical point causing the failure of the device. Under this conditions the forth embodiment is cheaper than the exchanger according to the third embodiment.

The invention claimed is:

1. A heat exchange device (1) for EGR systems with heat exchange between a first fluid, preferably an EGR gas, circulating through a conduit and a second fluid, preferably a coolant liquid, circulating through a second conduit, where said device is intended for being intercalated between both conduits and comprises:

a plurality of extruded aluminium profile segments (1.1) such that:

they preferably extend according to a longitudinal direction (X), they have one or more closed inner cavities (1.1.1) giving rise to conduits in the longitudinal direction (X) of the profile intended for conducting the first fluid; and where, this plurality of segments (1.1) are arranged distributed along a direction (Z) transverse to the longitudinal direction (X) and spaced from one another, a first perforated or grooved clad aluminium plate (1.2), i.e., having a layer of aluminium with a melting point lower than the rest of the aluminium of the same plate on at least one of its surfaces, where the perforations (1.2.1) or grooves are suitable for housing one of the ends of the plurality of profile segments (1.1) such that said first plate (1.2) is essentially perpendicular to such profile segments, and where such perforations (1.2.1) or grooves have a configuration according to the section of the profile segments (1.1) which they house, a second (1.3) and a third (1.4) clad aluminium plate where, the second plate (1.3) is in the form of a perimetric ring and is intended for surrounding the plurality of profile segments (1.1), the third plate (1.4) is perforated or grooved, where the perforations (1.4.1) or grooves are suitable for housing the ends of the plurality of profile segments (1.1) opposite the end where the first plate (1.2) is located according to the longitudinal direction (X), and where such perforations (1.4.1) or grooves have a configuration according to the section of the profile segments (1.1) which they house, where both the second (1.3) and the third (1.4) plates are essentially perpendicular to such profile segments (1.1), a first side clad plate and a second side clad plate (1.6, 1.7) extending between the first aluminium plate (1.2) and the second aluminium plate (1.3) and are (1.6, 1.7) suitable for covering the sides of the profile segments (1.1) defining intermediate chambers between consecutive profile segments (1.1), where:

the attachment between the side plates (1.6, 1.7) and the profile segments (1.1); and the attachment between the first plate (1.2), the second plate (1.3) and the third plate (1.4) with the profile segments (1.1) is by means of melting the aluminium with lower melting point of the clad plates, at the end of the profile segments (1.1) according to the longitudinal direction (X) where the third plate (1.4) is located, the intermediate chambers between consecutive profile segments (1.1) are in communication with a main chamber (C) which in turn is in communication with connection means (1.5.1, 1.7.1) for the entry/exit of the second fluid; and the device comprises connection means (1.6.1) for connecting with the conduit of the second entering/exiting fluid, where such connection means (1.6.1) have access to the intermediate chambers between the profile segments (1.1); where these connection means (1.6.1; 1.5.1, 1.7.1) allow intercalating the device (1) in the conduit of the second fluid; and, the first plate and the third plate (1.2, 1.4) comprise connection means which allow intercalating the device (1) in the conduit of the first fluid where the connection means of the third plate (1.4) correspond to the inlet of the first fluid and the connection means of the first plate (1.2) correspond to the outlet of the first fluid; and, wherein a tubular distribution body (1.5) is located between the second plate (1.3) and the third plate (1.4), according to the longitudinal direction (X), where the inner face of this tubular distribution body (1.5) is separated at least in one region of the tube segments (1.1) giving rise to the main chamber (C) such that at least one portion of the profile segments (1.1) is housed inside the tubular distribution body (1.5) between the second plate (1.3) and the third plate (1.4).

2. The device according to claim 1, characterized in that the tubular distribution body (1.5) is located between the second plate (1.3) and the third plate (1.4) such that said plates are spaced by said tubular body (1.5).

3. The device according to claim 2, characterized in that it comprises a manifold (1.10) preferably having a conical configuration coupled to the third plate (1.4).

4. The device according to claim 1, characterized in that in at least one outer face of the group of profile segments (1.1) there is a clad plate adjacent to said outer face, being interposed between the profile segments (1.1) and the inner edge of any of the first plate (1.2), second plate (1.3) or third plate (1.4) for improving the attachment.

5. The device according to claim 1, characterized in that the tubular distribution body (1.5) comprises connection means (1.5.1) for the entry/exit of the second fluid where such connection means (1.5.1) have access to the main chamber (C) inside said tubular distribution body (1.5).

6. The device according to claim 1, characterized in that the perimetric surface of the portion of the profile segments (1.1) located between the second plate and the third plate (1.3, 1.4) is inside the inner main chamber (C) of the tubular distribution body (1.5), where the chamber (C) is suitable for distributing the second fluid around said portion of profile segments (1.1).

7. The device according to claim 1, characterized in that the tubular body (1.5) is elongated according to the longitudinal direction (X), in the entry direction of the first fluid by means of an intake manifold (1.10) defining a second chamber (CC) therein such that:

the intake manifold (1.10) connecting the inlet of the first fluid and the third plate (1.4) for directing the first fluid from the inlet to the closed inner cavities (1.1.1) of the profile segments (1.1) is housed inside the second chamber (CC), the second chamber (CC) is mainly located between the tubular body (1.5) and the intake manifold (1.10) arranged internally for allowing the perimetric distribution of the second fluid, the second chamber (CC) and the main chamber (C) are communicated with one another for transferring the second fluid between the chamber (CC) and the main chamber (C) mainly according to a longitudinal direction (X), the connection means (1.5.1) for the entry/exit of the second fluid into the tubular body (1.5) have access to the second chamber (CC).

8. The device according to claim 1, characterized in that the profile segments (1.1) have an essentially planar configuration with a preferably rectangular section.

9. The device according to claim 5, characterized in that the connection means (1.5.1) for connecting with the tubular distribution body (1.5) have the inlet/outlet contained in a plane parallel to that defined by the profile segments (1.1).

10. The device according to claim 1, characterized in that it comprises a comb-shaped clad baffle plate (1.8) with at least one main body (1.8.1) and one or more transverse prolongations (1.8.2) such that the main body (1.8.1) is located on the side of the profile segments (1.1) arranged on the side of the inlet/outlet (1.5.1, 1.7.1) of the second fluid and the transverse prolongations (1.8.2) are located between consecutive profile segments (1.1) for distributing the flow of the second fluid throughout the transverse section in the cavities through which said fluid circulates.

11. The device according to claim 10, characterized in that the baffle plate (1.8) is arranged parallel to the second plate (1.3).

12. The device according to claim 10, characterized in that the baffle plate (1.8) is arranged obliquely with the ends of its prolongations (1.8.2) oriented towards the third plate (1.4).

13. The device according to claim 10, characterized in that the baffle plate (1.8) is arranged spaced from the second plate (1.3).

14. The device according to claim 1, characterized in that the second plate (1.3) comprises internal prolongations (1.3.1) located between consecutive profile segments (1.1) for distributing the flow of the second fluid in the cavities through which said fluid circulates.

15. The device according to claim 1, characterized in that the connection means (1.6.1) for connecting with the side plate (1.6) comprise a tubular body attached to the side plate (1.6) by means of a bulked area (1.6.2) such that the bulked area (1.6.2) defines an inner cavity facilitating the access from the tubular body to the cavities located between profile segments (1.1).

16. The device according to claim 15, characterized in that the tubular body of the connection means (1.6.1) is oriented towards the first plate (1.2).

17. An EGR system comprising a heat exchanger according to any of the preceding claims.

18. A vehicle comprising an EGR system according to claim 17.

* * * * *